US007591640B2

(12) United States Patent
Masuda et al.

(10) Patent No.: US 7,591,640 B2
(45) Date of Patent: Sep. 22, 2009

(54) THREE GEAR TYPE GEAR PUMP OF A FUEL SUPPLY SYSTEM

(75) Inventors: Seiei Masuda, Tokyo (JP); Yasushi Matsunaga, Hanno (JP)

(73) Assignee: Ishikawajima-Harima Heavy Industries Co., Ltd. (JP)

( * ) Notice: Subject to any disclaimer, the term of this patent is extended or adjusted under 35 U.S.C. 154(b) by 0 days.

(21) Appl. No.: 11/468,318

(22) Filed: Aug. 30, 2006

(65) Prior Publication Data

US 2008/0056926 A1 Mar. 6, 2008

(51) Int. Cl.
*F04C 18/00* (2006.01)
*F04C 2/00* (2006.01)

(52) U.S. Cl. ..... 418/196; 418/10; 418/191

(58) Field of Classification Search ..... 418/191, 418/196, 197, 206.1, 206.5, 9, 10
See application file for complete search history.

(56) References Cited

U.S. PATENT DOCUMENTS

| | | | | |
|---|---|---|---|---|
| 3,288,076 | A * | 11/1966 | Bjφrndal | 418/196 |
| 4,386,893 | A * | 6/1983 | Hauser, Jr. | 418/191 |
| 4,548,557 | A * | 10/1985 | Janczak | 418/206.7 |
| 5,032,068 | A * | 7/1991 | Kurherr | 418/196 |
| 6,540,493 | B1 | 4/2003 | Korner | |

FOREIGN PATENT DOCUMENTS

| | | | |
|---|---|---|---|
| JP | S47-28505 | | 11/1972 |
| JP | S51-120408 | | 10/1976 |
| JP | 2000-179467 | | 6/2000 |
| JP | 2002-529644 | | 9/2002 |
| JP | 2002303160 | A * | 10/2002 |
| JP | 2003328958 | A * | 11/2003 |
| JP | 2005042627 | A * | 2/2005 |
| JP | 2005232980 | A * | 9/2005 |
| WO | WO 2004/004836 | A1 | 1/2004 |
| WO | WO 2006/024101 | A1 | 3/2006 |

OTHER PUBLICATIONS

Communication from unrelated third party dated Apr. 9, 2008 forwarding assembly drawing of a three gear pump by Roper Pump.

Office Action issued in counterpart Japanese Application No. 2004-39644 dated May 27, 2008 with English translation.

Office Action dated Aug. 11, 2008 in counterpart Canadian application 2,558,201 (4 pages).

* cited by examiner

*Primary Examiner*—Theresa Trieu
(74) *Attorney, Agent, or Firm*—Ostrolenk Faber LLP

(57) ABSTRACT

A three-gear type gear pump or double gear pump wherein the first driven gear and the second driven gear are opposed to one another with the driving gear disposed between them, wherein the number of teeth of the driving gear is greater than the number of teeth of each of the first driven gear and the second driven gear.

6 Claims, 2 Drawing Sheets

FIG. 3 - PRIOR ART -

THREE GEAR TYPE GEAR PUMP OF A FUEL SUPPLY SYSTEM

BACKGROUND OF THE INVENTION

1. Field of the Invention

The present invention relates to a novel gear pump.

2. Description of the Related Art

Generally, a conventional fuel supply system of a jet engine (turbo fan engine) used in an aircraft or the like is structured such that a fuel pump (which is also a booster) increases pressure of fuel fed from a fuel tank and then a fuel measuring mechanism determines a flow rate of the fuel, and based on the determination, it supplies some of the fuel to an engine combustor of the jet engine and at the same time returns the remaining fuel or surplus fuel to an inlet of the fuel pump.

In this structure, as the fuel pump, a gear pump 100 shown in FIG. 3 has been heretofore used. In this case, the gear pump is operated by gears within a gear box (AGB: accessory gear box) due to a rotational movement transmitted from the engine. Thus, the discharge rate of the gear pump is generally in proportion to the engine revolutions.

By mean of the gear pump 100, by retaining fuel in closed spaces formed by an inner face of a casing and the gear, it is possible to achieve pressurization of the fuel. In the same figure, IP denotes an inlet port for fuel and EP denotes an exhaust port for fuel.

Recently, a proposal has been made to use a three-gear type gear pump (Double Gear Pump) as a fuel pump instead of using the gear pump 100. The three-gear type gear pump is provided with a driving gear and two driven gears opposed to one another across the driving gear. Fuel is entrapped in closed spaces each formed by two successive (consecutive) gear teeth of each driven gear and a casing whereby the thus retained fuel is pressurized. Therefore, when the driving gear rotates even at a low speed, a sufficient discharge rate can be obtained. See, for example, "GEAR PUMP" fifth edition, Tsuneo Ichikawa (author), (Nikkan Kogyo Shimbun, Ltd. Jan. 30, 1969), and "Investigation and Research on Innovative Aircraft Technological Development No. 1306" The Society of Japanese Aerospace Companies (SJAC), Innovative Aircraft Technological Development Center Mar. 29, 2002 (ISSN 1342-4017).

However, in the three-gear type gear pump as described above, since the driving gear is disposed between the two driven gears, it is subjected to oil pressure at both sides thereof whereby gaps or clearances between the driving gear and the driven gears are generated. As a result, fuel easily leaks from between the driving gear and the driven gears, and therefore, volumetric efficiency is significantly decreased.

SUMMARY OF THE INVENTION

In consideration of the above circumstances, an object of the present invention is to prevent leakage of fuel from between a driving gear and a driven gear and to thereby improve or increase a volumetric efficiency.

In order to achieve the above object, a first aspect of the present invention is characterized by a three-gear type gear pump (or Double Gear Pump) comprising: a driving gear; a first driven gear arranged in a meshing engagement with the driving gear; and a second driven gear arranged in a meshing engagement with the driving gear; wherein the number of teeth of the driving gear is greater than the number of teeth of each of the first driven gear and the second driven gear.

A second aspect of the present invention is characterized in that, regarding the first aspect of the present invention, the first driven gear and the second driven gear are opposed to one another with the driving gear disposed between them.

A third aspect of the present invention is characterized in that, regarding the first aspect of the present invention, the driving gear and the first driven gear constitute a first booster section; the driving gear and the second driven gear constitute a second booster section; and each of the first booster section and the second booster section has an inlet port and an exhaust port.

A fourth aspect of the present invention is characterized in that, regarding the first aspect of the present invention, the gear diameter of the driving gear is greater than the gear diameter of each of the first driven gear and the second driven gear.

A fifth aspect of the present invention is characterized in that, regarding the first aspect of the present invention, the first driven gear and the second driven gear have the same gear diameter and the same number of teeth.

A sixth aspect of the present invention is characterized in that, regarding the first aspect of the present invention, the driving gear, the first driven gear, and the second driven gear have involute profiles.

In the gear pump according to the present invention, since the number of teeth of the driving gear is greater than the number of teeth of the driven gear, it is possible to prevent leakage of fuel from between the driving gear and the driven gear. It is thereby possible to increase volumetric efficiency of the gear pump.

BRIEF DESCRIPTION OF THE DRAWINGS

FIG. 1A and FIG. 1B are general structural views of a fuel pump of an embodiment according to the present invention, wherein FIG. 1A is a general structural view of the fuel pump (gear pump) of a three-gear type according to the present embodiment, and FIG. 1B is a cross-sectional view taken along I-I line of FIG. 1A.

FIG. 3 is a general structural view of a conventional fuel pump.

DETAILED DESCRIPTION OF THE INVENTION

With reference to the drawings, an embodiment of a gear pump according to the present invention will be described hereinafter. However, the present invention is not to be considered as being limited to the embodiment below. For example, it would be appropriately acceptable to combine the various structural elements of the embodiment with one another, and it would be acceptable to add or substitute other per se known structures.

Figure 1A:
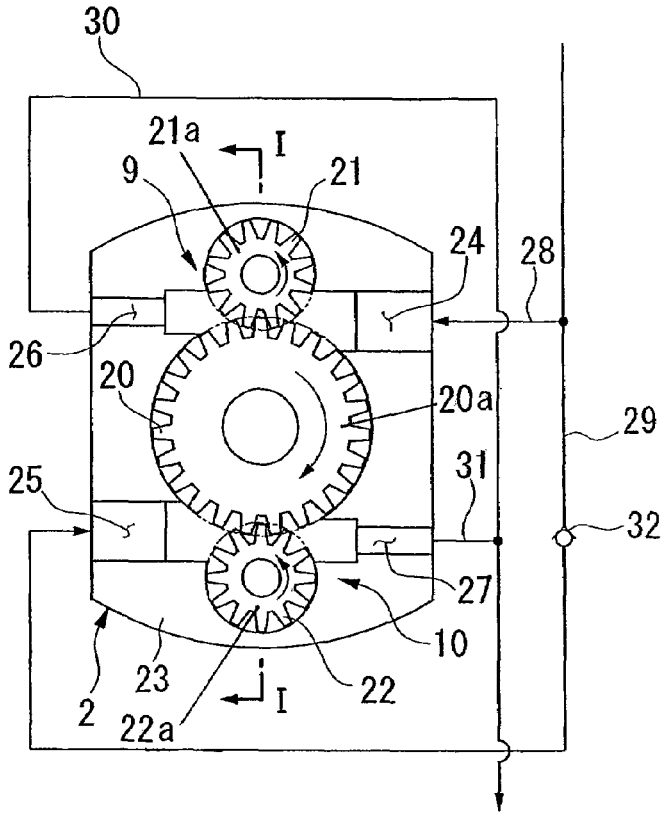
Figure 1B:
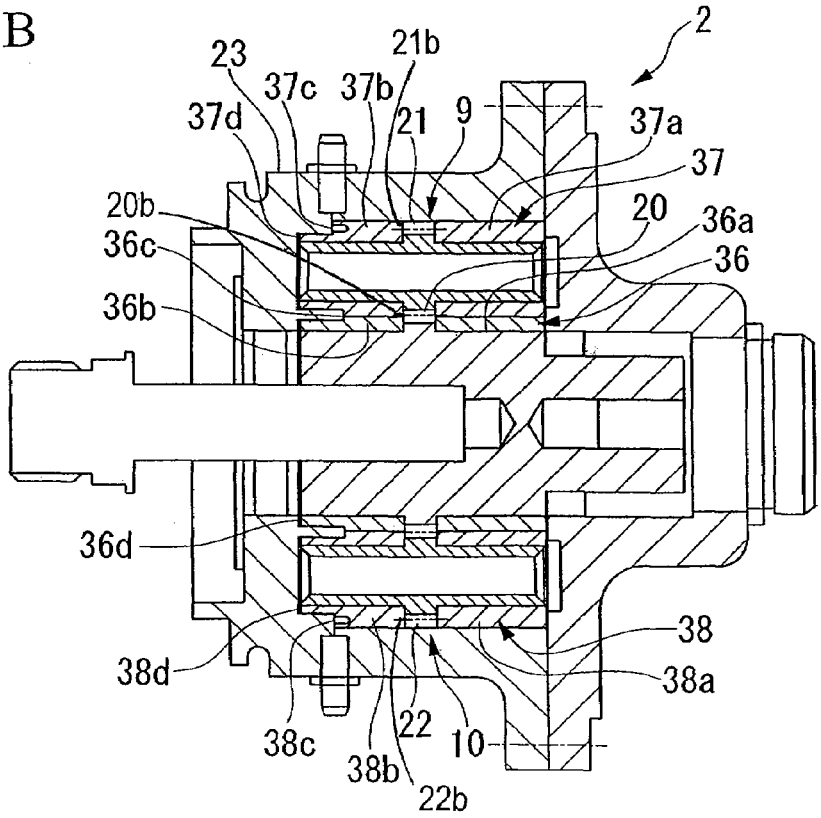
Figure 2:
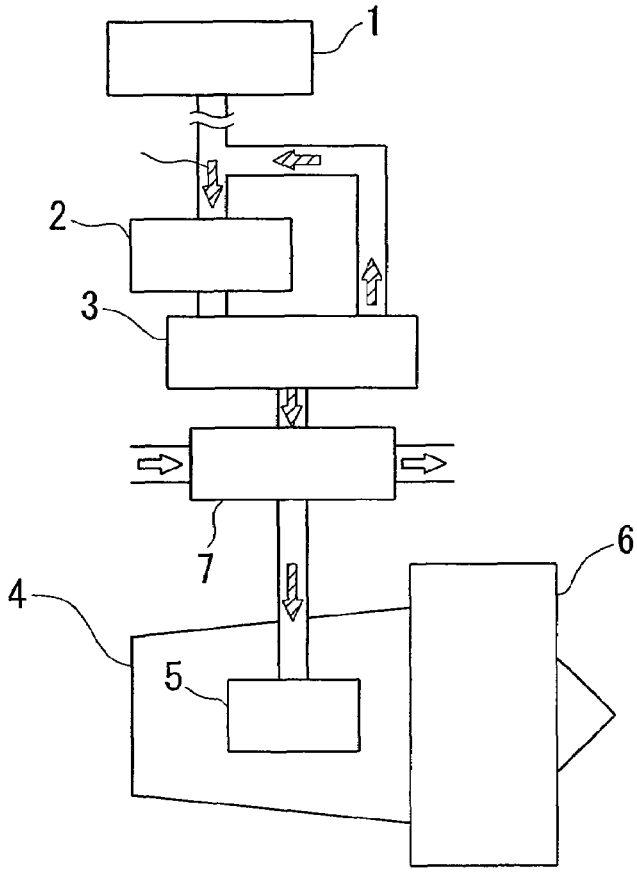
FIG. 2 is a schematic diagrammatical view of an example of a fuel supply system having a fuel pump 2 according to the present embodiment.
Figure 2:
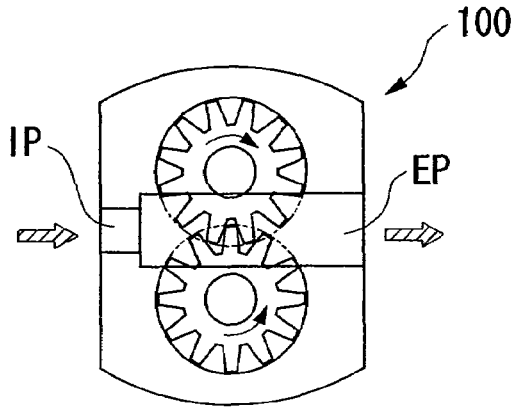

FIG. 1A is a general structural view illustrating a three-gear type fuel pump (gear pump) 2 according to the present invention. FIG. 1B is a cross-sectional view taken along line I-I of FIG. 1A. FIG. 2 is a schematic diagrammatical view of an example of a fuel supply system having the fuel pump 2 according to the present invention.

As shown in FIG. 2, the fuel supply system equipped with the fuel pump 2 according to the present embodiment is further provided with, in addition to the fuel pump 2, a fuel tank 1 and a fuel measuring mechanism 3 and is connected to a jet engine 4. The jet engine 4 is provided with an engine combustor 5 and a fan 6. A fuel-cooling oil cooler 7 for cooling fuel is disposed between the jet engine 4 and the fuel supply system.

The fuel tank 1 is a tank in which fuel to be supplied to the jet engine 4 is reserved. The fuel pump 2 is disposed downstream of the fuel tank 1. The fuel measuring mechanism 3 is disposed downstream of the fuel pump 2. The fuel measuring mechanism 3 determines a flow rate of fuel in accordance with information transmitted thereto, e.g., positional information of a throttle lever provided in an aircraft. Based on the thus determined flow rate of fuel, it supplies to the jet engine 4 some of the fuel, which has been pumped out from the fuel pump 2, and returns the remaining or surplus fuel to an inlet of the fuel pump 2.

Referring now to FIGS. 1A and 1B, a structure of the fuel pump 2 according to the present embodiment will be described in detail.

The fuel pump 2, which is the three-gear type gear pump as described above, has a driving gear 20 and two driven gears (a first driven gear 21 and a second driven gear 22) which are diametrically disposed with respect to one another in such a manner that the driving gear 20 is disposed therebetween. The driving gear 20 receives a rotational movement from a drive source including the jet engine 4 (see FIG. 2) or the like and outputs a drive force corresponding thereto.

As shown in FIGS. 1A and 1B, the first driven gear 21 and the second driven gear 22 are of the same gear diameter and have the same number of teeth. The driving gear 20 has a gear diameter about twice that of each of the first driven gear 21 and the second driven gear 22 and also has a number of teeth about twice that of teeth of each of the first driven gear 21 and the second driven gear 22. In other words, they are structured such that the number of teeth of the driving gear 20 is larger than that of each of the first driven gear 21 and the second driven gear 22 and that the gear diameter of the driving gear 20 is larger than that of each of the first driven gear 21 and the second driven gear 22. The involute tooth profile can be preferably used as tooth profiles of the first driven gear 21 and the second driven gear 22. However, the present invention is not limited to this. For example, a spur-tooth shape, a beveled-tooth shape, a sine-curve-tooth shape or a trochoid-curve-tooth shape can also be adopted. FIG. 1A further illustrates the first side surface 20*a* of the driving gear, and the first side surfaces 21*a*, 22*a* of each of the first driven gear and the second driven gear, respectively.

The driven gears 21 and 22 are respectively meshed with the driving gear 20 within a casing 23. Fuel is introduced between the driving gear 20 and the driven gear 21 via a first inlet port 24 and also between the driving gear 20 and the driven gear 22 via a second inlet port 25. In response to each rotation of the driven gears 21 and 22, the thus introduced fuel is retained in closed spaces one by one each defined by a tooth surface of each of the driven gears 21 and 22 and by an inner surface of the casing 23 such that each retained fuel is pressurized. Thereafter, the fuel is discharged via a first exhaust port 26 and a second exhaust port 27. In other words, the fuel pump 2 is structured and provided with a first booster section 9 which is mainly composed of the driving gear 20 and the first driven gear 21 and a second booster section 10 which is mainly composed of the driving gear 20 and the second driven gear 22. Accordingly, the first booster section 9 and the second booster section 10 have the same discharge rate in terms of the number of rotations of the driving gear 20.

The first inlet port 24 and the second inlet port 25 are connected to a first inlet line 28 and a second inlet line 29, respectively, both of the lines 28 and 29 being led out from the fuel tank 1 (see FIG. 2). The first exhaust port 26 and the second exhaust port 27 are connected to a first discharge line 30 and a second discharge line 31, respectively, both of the lines 30 and 31 being led to the fuel measuring mechanism 3 (see FIG. 2). A check valve 32 is arranged in the middle of the second inlet line 29 such that it prevents a backflow from the second inlet line 29 to the first inlet line 28. Further, the first inlet line 28 and the second inlet line 29 are connected to a return line (not illustrated in FIG. 1) through which surplus fuel having been discharged from the below-mentioned fuel measuring mechanism 3 flows backward The driving gear 20, the first driven gear 21, and the second driven gear 22 are rotatably supported by a main bearing 36, a first bearing 37, and a second bearing 38, respectively, each formed of a journal bearing or the like. Each of the bearings 36, 37 and 38 has a stationary side plate (36*a*, 37*a*, 38*a*) which is fixed at one side surface side of the gear corresponding thereto and a movable side plate (36*n*, 37*b*, and 38*b*) which is provided so as to be axially moveable at the other side surface side (that is, at second side surface 20*b* of the driving gear 20, second side surface 21*b* of the first driven gear 21, and second side surface 22*b* of the second driven gear 22). Further, the fuel pump 2 exerts fluid pressure (or fuel pressure) on high-pressure-bearing surfaces of the moveable side plates 36*b*, 37*b*, and 38*b* whereby the moveable side plates 36*b*, 37*b*, and 38*b* are pressed against the side surfaces of the respective gear so as to form a seal.

Returning to FIG. 2, the fuel measuring mechanism 3 is disposed downstream of the aforesaid fuel pump 2 and supplies to the jet engine a predetermined amount of fuel which has been pressurized by the fuel pump 2. The fuel measuring mechanism 3 receives positional information of e.g., a throttle lever, and then, it determines the amount of fuel to be supplied to the jet engine 4 in response to this information. Further, as shown in the same figure, the fuel measuring mechanism 3 returns remaining or surplus fuel (which is no longer supplied to the jet engine 4) to the fuel pump 2 via the return line.

The fuel-cooling oil cooler 7 is a heat exchanger for transferring heat from an engine lubricant to fuel and is disposed between the fuel measuring mechanism 3 and the jet engine 4.

As described above, the jet engine 4 is provided with the engine combustor 5 and the fan 6. In the jet engine 4, fuel supplied to the engine combustor 5 from the fuel-cooling-oil cooler is burned. By using energy obtained by this burning, the fan 6 is driven to thereby generate rotational power.

Next, the operation of the thus structured fuel supply system that is provided with the fuel pump 2 of the present embodiment will be described below.

Firstly, fuel that is stored in the fuel tank 1 is supplied to the fuel pump 2. At this time, fuel is supplied through the first inlet line 28 and the second inlet line 29 to the first inlet port 24 and the second inlet port 25 of the fuel pump 2. In response to rotation of the first driven gear 21 driven by the driving gear 20, the fuel which has been thus supplied to the first inlet port 24 is retained in the closed spaces each defined by the teeth of the first driven gear 21 and the inner surface of the casing 23 such that each retained fuel is pressurized. Thereafter, the fuel is discharged from the fuel pump 2 through the first exhaust port 26. Similarly, in response to rotation of the second driven gear 22 driven by the driving gear 20, the fuel which has been thus supplied to the second inlet port 25 is retained in the closed spaces each defined by the teeth of the second driven gear 22 and the inner surface of the casing 23 such that each retained fuel is pressurized. Thereafter, the fuel is discharged from the fuel pump 2 through the second exhaust port 27.

Accordingly, the fuel in the first and second exhaust ports 26 and 27 is in a state such that the pressure is raised higher than the fuel in the first and second inlet ports 24 and 25. Therefore, if a gap exists between the driving gear 20 and the first driven gear 21 and a gap exists between the driving gear 20 and the second driven gear 22, the fuel in the first exhaust port 26 easily leaks into the first inlet port 24 and the fuel in the second exhaust port 27 easily leaks into the second inlet port 25.

In contrast, as described above, in the fuel pump 2 according to the present embodiment, the driving gear 20 has a gear diameter about twice the gear diameter of each of the first driven gear 21 and the second driven gear 22 and a larger number of teeth than the number of teeth of each of the first driven gear 21 and the second driven gear 22. Therefore, since a speed of rotation of each of the first driven gear 21 and the second driven gear 22 is increased as compared to a conventional gear pump, it is possible to substantially reduce a face-width of each of the first driven gear 21 and the second driven gear 22 as compared to the conventional gear pump. Accordingly, as compared to the conventional gear pump, it is possible to reduce an area of each tooth tip of the gears. As a result, it is possible to prevent leakage of fuel from between the driving gear 20 and the first driven gear 21 and from between the driving gear 20 and the second driven gear 22.

Additionally, if a gap exists between the driving gear 20 and the inner surface of the casing 23, the fuel in the first exhaust port 26 easily leaks into the second inlet port 25. In contrast, since the driving gear 20 according to the present embodiment has about twice the number of teeth of a conventional driven gear, a pressure drop between the driving gear and the inner surface of the casing 23 is increased such that leakage of fuel from the first exhaust port 26 to the second inlet port 25 can be prevented.

Incidentally, when the number of teeth of the driving gear 20 changes from N to (N+M), where N denotes the number of teeth of each of driven gear 21 and 22, the leakage of fuel from between the driving gear and the driven gears 21 and 22 decreases or becomes $(N+M)^{0.5}$. Accordingly, theoretically speaking, the greater the number of teeth of the driving gear 20, the smaller the leakage of fuel. Whereas, the greater the number of teeth of the driving gear 20, the greater the diameter of the driving gear 20. That is, the size of the fuel pump inevitably becomes large. Therefore, empirically speaking, it is preferable that the number of teeth of the driving gear 20 be about twice the number of teeth of the driven gears 21, 22.

Further, with the driving gear 20 having a large diameter, the flow rate of fuel can be increased even under the same conditions in rotation. Conversely, when the flow rate of fuel is set at substantially the same level that used conventionally, a face-width of the gears can be N/(N+M), whereby leakage of fuel can potentially be prevented.

As described above, in the fuel pump 2 according to the present embodiment, it is possible to prevent leakage of fuel from a high pressure side to a low pressure side, and hence, to increase the volumetric efficiency of the fuel pump.

The thus pressurized fuel is discharged from the fuel pump 2 and is supplied to the fuel measuring mechanism 3 through the first discharge line 30 and the second discharge line 31. Some of fuel or a predetermined amount of fuel in the fuel measuring mechanism 3 is supplied to the jet engine 4, and the remaining fuel or surplus fuel in the fuel measuring mechanism 3 is pressure-released and returned to the fuel pump 2.

Next, the thus discharged/supplied fuel from the fuel supply system (the fuel measuring mechanism 3) to the jet engine 4 is thermally interchanged with an oil used in the jet engine 4, and thereafter, supplied to the engine combustor 5 of the jet engine 4. Then, the fuel in the engine combustor 5 is burned. The use of energy generated by the fuel burning allows the fan 6 to be rotated and thereby generate rotational power.

Although the preferred exemplary embodiment according to the present invention has been described with reference to the appended drawings, it goes without saying that the present invention is by no means limited to the above-described embodiment. Shapes of such structural elements and a combination thereof as described in the aforesaid embodiment are simply an example, and therefore, they can be modified in accordance with a design need or the like without departing from the scope or subject matter of the present invention For example, as an application, in the aforesaid embodiment, the fuel supply system provided with the fuel pump 2 as a structural component has been described. However, a gear pump according to the present invention is not limited to a gear pump that is provided in such a fuel supply system. The present invention can be applied to all three-gear type gear pumps in which a fluid is pressurized and then discharged.

Additionally, although the engine lubricant (oil) is cooled by only using fuel in the aforesaid embodiment, the cooling means is not limited to this. For example, the oil may be further cooled by using some of the air discharged from the fan 6 as a bleed air for cooling the oil.

What is claimed is:

1. A three gear type gear pump of a fuel supply system of a jet engine, comprising:

a driving gear comprising a first side surface and a second side surface;

a first driven gear positioned to be in a meshing engagement with the driving gear, and comprising a first side surface and a second side surface;

a second driven gear positioned to be in a meshing engagement with the driving gear, and comprising a first side surface and a second side surface;

a first stationary side plate positioned to touch in a sliding manner the first side surface of the driving gear, a second stationary side plate positioned to touch in a sliding manner the first side surface of the first driven gear, and a third stationary side plate positioned to touch in a sliding manner the first side surface of the second driven gear; and a first moveable side plate positioned to touch in a sliding manner the second side surface of the driving gear, a second moveable side plate positioned to touch in a sliding manner the second side surface of the first driven gear, and a third moveable side plate positioned to touch in a sliding manner the second side surface of the second driven gear, wherein the number of teeth of the driving gear is twice as large as the number of teeth of each of the first driven gear and the second driven gear, and wherein the first, second and third moveable side plates are pressed against the respective second side surfaces of the driving gear, the first driven gear and the second driven gear to prevent leakage.

2. The three gear type gear pump as recited in claim 1, wherein the first driven gear and the second driven gear are opposed to one another with the driving gear disposed between them.

3. The three gear type gear pump as recited in claim 1, wherein the driving gear and the first driven gear constitute a first booster section, wherein the driving gear and the second driven gear constitute a second booster section, and wherein each of the first booster section and the second booster section has an inlet port and an exhaust port.

4. The three gear type gear pump as recited in claim 1, wherein the gear diameter of the driving gear is greater than the gear diameter of each of the first driven gear and the second driven gear.

5. The three gear type gear pump recited in claim 1, wherein the first driven gear and the second driven gear have the same gear diameter and the same number of teeth.

6. The three gear type gear pump as recited in claim 1, wherein the driving gear, the first driven gear, and the second driven gear have involute profiles.

* * * * *